US009355593B2

(12) United States Patent
Jeong et al.

(10) Patent No.: US 9,355,593 B2
(45) Date of Patent: May 31, 2016

(54) PIXEL AND ORGANIC LIGHT EMITTING DISPLAY USING THE SAME

(75) Inventors: Jin-Tae Jeong, Yongin (KR); Oh-Kyong Kwon, Seoul (KR)

(73) Assignees: Samsung Display Co., Ltd., Yongin-si (KR); Industry-University Corporation Foundation Hanyang-University, Seoul (KR)

( * ) Notice: Subject to any disclaimer, the term of this patent is extended or adjusted under 35 U.S.C. 154(b) by 124 days.

(21) Appl. No.: 13/569,154

(22) Filed: Aug. 7, 2012

(65) Prior Publication Data

US 2013/0222356 A1 Aug. 29, 2013

(30) Foreign Application Priority Data

Feb. 28, 2012 (KR) ..... 10-2012-0020260

(51) Int. Cl.
*G09G 3/30* (2006.01)
*G09G 3/32* (2016.01)

(52) U.S. Cl.
CPC ..... *G09G 3/3233* (2013.01); *G09G 3/3208* (2013.01); *G09G 3/3283* (2013.01); *G09G 2300/0819* (2013.01); *G09G 2300/0842* (2013.01); *G09G 2300/0861* (2013.01); *G09G 2300/0866* (2013.01)

(58) Field of Classification Search
USPC ..... 345/48, 77, 82
See application file for complete search history.

(56) References Cited

U.S. PATENT DOCUMENTS 7,579,781 B2 8/2009 Lee et al.
7,737,927 B2 * 6/2010 Kwon ..... 345/82
8,269,803 B2 9/2012 Yoo et al.
8,674,906 B2 * 3/2014 Hwang et al. ..... 345/76
2005/0264500 A1 * 12/2005 Shirasaki et al. ..... 345/77
2006/0097966 A1 * 5/2006 Choi ..... 345/77
2006/0103323 A1 * 5/2006 Eom et al. ..... 315/169.3
2006/0132053 A1 6/2006 Cho et al.

(Continued)

FOREIGN PATENT DOCUMENTS

CN 102222463 A 10/2011
CN 102243840 A 11/2011

(Continued)

OTHER PUBLICATIONS

SIPO Office action dated Apr. 6, 2016, for corresponding Chinese Patent application 201210357015.4, (18 pages).

*Primary Examiner* — Linh N Hoffner
(74) *Attorney, Agent, or Firm* — Lewis Roca Rothgerber Christie LLP

(57) ABSTRACT

A pixel having a simplified structure can compensate for the threshold voltage of a driving transistor thereof. The pixel includes an organic light emitting diode (OLED) having a cathode electrode coupled to a second power source, a storage capacitor coupled between a data line and a first node, a second transistor having a first electrode coupled to a first power source, a second electrode coupled to an anode electrode of the OLED, and a gate electrode coupled to the first node, a first transistor coupled between the first node and the second electrode of the second transistor, a gate electrode of the first transistor being coupled to a current scan line, and a third transistor coupled between the second electrode of the second transistor and the anode electrode of the OLED, a gate electrode of the third transistor being coupled to a control line.

23 Claims, 6 Drawing Sheets

(56) References Cited

U.S. PATENT DOCUMENTS

| | | | | |
|---|---|---|---|---|
| 2006/0145967 | A1* | 7/2006 | Huh | G09G 3/325 345/76 |
| 2006/0208973 | A1 | 9/2006 | Lee et al. | |
| 2007/0210998 | A1* | 9/2007 | Chiou et al. | 345/82 |
| 2009/0225011 | A1* | 9/2009 | Choi | 345/77 |
| 2009/0278837 | A1* | 11/2009 | Schwanenberger et al. | 345/214 |
| 2010/0118059 | A1* | 5/2010 | Senda | 345/690 |
| 2010/0220091 | A1* | 9/2010 | Choi | 345/213 |
| 2011/0273441 | A1 | 11/2011 | Shin | |
| 2012/0026145 | A1 | 2/2012 | Jeong | |
| 2014/0307012 | A1* | 10/2014 | Kishi | 345/691 |

FOREIGN PATENT DOCUMENTS

| | | |
|---|---|---|
| KR | 10-2006-0068538 | 6/2006 |
| KR | 10-2006-0100877 | 9/2006 |
| KR | 10-2012-0012597 | 2/2012 |

* cited by examiner

PIXEL AND ORGANIC LIGHT EMITTING DISPLAY USING THE SAME

CROSS-REFERENCE TO RELATED APPLICATION

This application claims priority to and the benefit of Korean Patent Application No. 10-2012-0020260, filed on Feb. 28, 2012, in the Korean Intellectual Property Office, the entire content of which is incorporated herein by reference.

BACKGROUND

1. Field

The present invention relates to a pixel and an organic light emitting display using the same, and more particularly, to a pixel capable of simplifying the structure thereof and an organic light emitting display using the same.

2. Description of the Related Art

In general, a pixel of an organic light emitting display includes a thin film transistor (TFT) and a capacitor. The TFT includes a semiconductor layer for providing a channel region and source and drain regions, a gate electrode provided on the semiconductor layer of the channel region and electrically insulated from the semiconductor layer by a gate insulating layer, and source and drain electrodes respectively connected to the semiconductor layer of the source and drain regions. The capacitor includes two electrodes and a dielectric layer interposed between the two electrodes.

Among various types of flat panel displays (FPDs), an organic light emitting display displays images using organic light emitting diodes (OLEDs) that generate light by the re-combination of electrons and holes. The organic light emitting display has a high response speed and is driven with low power consumption.

The organic light emitting display includes a plurality of pixels arranged at the crossing regions of a plurality of data lines, scan lines, and power source lines in a matrix. Each of the pixels includes an organic light emitting diode (OLED), at least two transistors including a driving transistor, and at least one capacitor.

The above-described organic light emitting display has low power consumption. However, the amount of current that flows to the OLED changes in accordance with a variation in the threshold voltage of a driving transistor included in each of the pixels so that non-uniformity in display is caused. That is, the characteristic of the driving transistor changes in accordance with the manufacturing process variables of the driving transistor included in each of the pixels. Generally, it is very difficult to make all of the transistors of the organic light emitting display have the same characteristics in current processes so that a variation in the threshold voltage of the driving transistor is generated.

In order to solve the above-described problem, a method of adding a compensating circuit including a plurality of transistors and capacitors to each of the pixels has been suggested. The compensating circuit included in each of the pixels changes a voltage corresponding to the threshold voltage of the driving transistor to compensate for the variation in the threshold voltage of the driving transistor. However, because the compensating circuit typically adds no less than six transistors in a pixel, the structure of the pixel becomes more complicated. In addition, the probability of erroneous operations increases due to the increased number of transistors included in the pixel resulting in deteriorated yield.

SUMMARY

Accordingly, embodiments of the present invention have been made to provide a pixel capable of simplifying the structure thereof and of compensating for the threshold voltage of a driving transistor and an organic light emitting display using the same.

According to one embodiment, a pixel includes an organic light emitting diode (OLED) having a cathode electrode coupled to a second power source, and an anode electrode, a storage capacitor coupled between a data line and a first node, a second transistor having a first electrode coupled to a first power source, a second electrode coupled to the anode electrode of the OLED, and a gate electrode coupled to the first node, a first transistor coupled between the first node and the second electrode of the second transistor, a gate electrode of the first transistor being coupled to a current scan line, and a third transistor coupled between the second electrode of the second transistor and the anode electrode of the OLED, a gate electrode of the third transistor being coupled to a control line.

The first power source may be configured to be at a first voltage in a partial period of a frame period, and at a second voltage higher than the first voltage in the other periods of the frame period. The third transistor may be configured to be turned on in a portion of the partial period in which the first power source may be at the first voltage. The first transistor may be configured to be turned on in a period partially overlapped with a turn-on period of the third transistor. The first power source may be configured to maintain a first voltage in a frame period, and the second power source may be configured to maintain a second voltage lower than the first voltage in the frame period.

The pixel may further include a fourth transistor coupled between the first node and an initialization power source, a gate electrode of the fourth transistor being coupled to a previous scan line. The initialization power source may be configured to be at a voltage lower than that of the first power source. A turn-on period of the third transistor may not be overlapped with a turn-on period of the first transistor.

According to another embodiment, a pixel includes an organic light emitting diode (OLED) having a cathode electrode coupled to a second power source, and an anode electrode, a storage capacitor coupled between a data line and a first node, a second transistor having a first electrode coupled to a first power source, a second electrode coupled to the anode electrode of the OLED, and a gate electrode coupled to the first node, a first transistor coupled between the first node and the second electrode of the second transistor, and having a gate electrode coupled to a current scan line, and a third transistor coupled between the second electrode of the second transistor and an initialization power source, a gate electrode of the third transistor being coupled to a control line.

The second power source may be configured to be at a first voltage in a partial period of a frame period, and at a second voltage lower than the first voltage in the other periods of the frame period. The third transistor may be configured to be turned on in the partial period in which the second power source may be at the first voltage. The first transistor may be configured to be turned on when the third transistor is turned on.

According to another embodiment, an organic light emitting display includes pixels positioned at crossing regions of scan lines, data lines, and control lines, a scan driver for concurrently supplying scan signals to the scan lines in a first period of a frame period and for sequentially supplying the scan signals to the scan lines in a second period of the frame period, a data driver for driving the data lines, a control line driver for supplying a control signal to a control line commonly coupled to the pixels in a partial period of the first period, a first power source driver for supplying a first power source to the pixels, and a second power source driver for supplying a second power source to the pixels. At least one of the first power source or the second power source is at a voltage that changes repeatedly between a first voltage and a second voltage lower than the first voltage in the frame period.

The second power source may be maintained at the second voltage in the frame period. The first power source may be at the second voltage in the first period to overlap the control signal and the scan signals in a partial period of the first period, and may be at the first voltage in the other periods of the frame period. The control line driver may be configured to supply the control signal to the control line in a third period of the frame period.

Each of the pixels may include an organic light emitting diode (OLED) having a cathode electrode coupled to the second power source, and an anode electrode, a storage capacitor coupled between a data line of the data lines and a first node, a second transistor having a first electrode coupled to the first power source, a second electrode coupled to the anode electrode of the OLED, and a gate electrode coupled to the first node, a first transistor coupled between the first node and the second electrode of the second transistor and configured to be turned on when a scan signal of the scan signals is supplied to a scan line of the scan lines, and a third transistor coupled between the second electrode of the second transistor and the anode electrode of the OLED, and configured to be turned on when the control signal is supplied to the control line.

The first power source may remain at the first voltage in the frame period, and the second power source may be at the first voltage in the first period, and may be configured to be at the second voltage in a third period of the frame period. Each of the pixels may include an organic light emitting diode (OLED) having a cathode electrode coupled to a second power source, and an anode electrode, a storage capacitor coupled between a data line of the data lines and a first node, a second transistor having a first electrode coupled to the first power source, a second electrode coupled to the anode electrode of the OLED, and a gate electrode coupled to the first node, a first transistor coupled between the first node and the second electrode of the second transistor, and configured to be turned on when the scan signals are supplied to the scan lines, and a third transistor coupled between the second electrode of the second transistor and an initialization power source, and configured to be turned on when the control signal is supplied to the control line. The initial power source may be configured to be at a voltage lower than the first voltage.

The data driver may be configured to supply data signals to the data lines in synchronization with the scan signals in the second period. The data driver may be configured to supply a voltage equal to or no less than a data signal of a black gray level, to the data lines in the first period and a third period of the frame period.

According to another embodiment, an organic light emitting display includes pixels positioned at crossing regions of scan lines, data lines, and a control line commonly coupled to the pixels, a scan driver for sequentially supplying scan signals to the scan lines in a first period of a frame period, a data driver for supplying data signals to the data lines in synchronization with the scan signals, and a control driver for supplying a control signal to the control line in a second period of the frame period excluding the first period. Each of the pixels includes an organic light emitting diode (OLED) having a cathode electrode coupled to a second power source, and an anode electrode, a storage capacitor coupled between a data line of the data lines and a first node, a second transistor having a first electrode coupled to a first power source, a second electrode coupled to the anode electrode of the OLED, and a gate electrode coupled to the first node, a first transistor coupled between the first node and the second electrode of the second transistor, and configured to be turned on when the scan signals are supplied to the scan lines, a third transistor coupled between the second electrode of the second transistor and the anode electrode of the OLED, and configured to be turned on when the control signal is supplied to the control line, and a fourth transistor coupled between the first node and an initialization power source, and configured to be turned on when a scan signal of the scan signals is supplied to a previous scan line of the scan lines.

The initialization power source may be configured to be at a voltage lower than that of the first power source.

In the pixel according to the embodiments of the present invention and the organic light emitting display using the same, the threshold voltage of the driving transistor may be stably compensated for using the pixel including no more than four transistors.

BRIEF DESCRIPTION OF THE DRAWINGS

The accompanying drawings, together with the specification, illustrate exemplary embodiments of the present invention, and together with the description, serve to explain the principles of the present invention.

DETAILED DESCRIPTION

Figure 1:
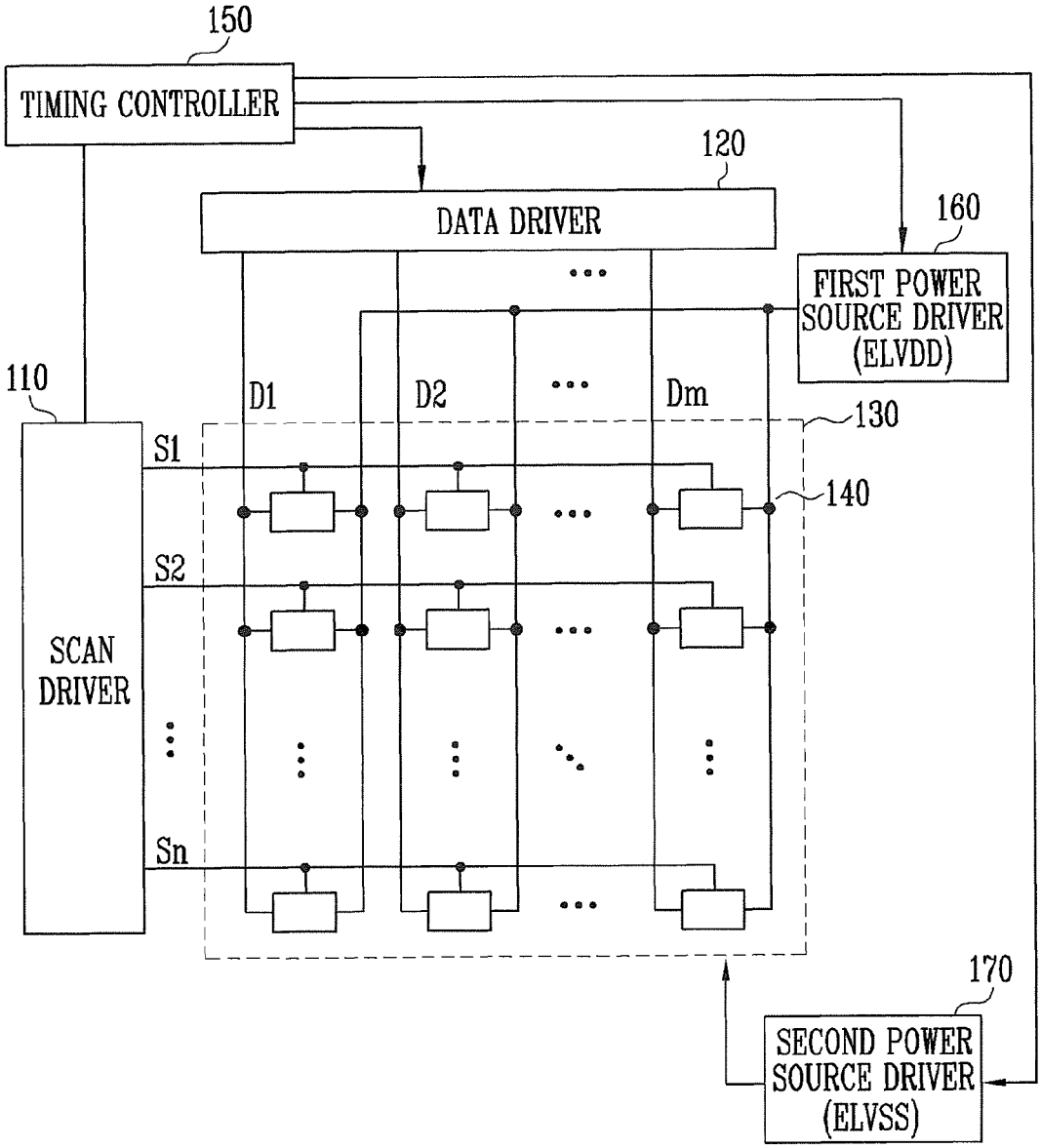
FIG. 1 is a view illustrating an organic light emitting display according to a first embodiment of the present invention.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to the complete understanding of the invention are omitted for clarity. Also, like reference numerals refer to like elements throughout.

Hereinafter, an organic light emitting display according to the present invention and a method of driving the same will be described in detail as follows with reference to FIGS. 1 to 10 in which various embodiments by which those skilled in the art may easily perform the present invention are included.

FIG. 1 is a view illustrating an organic light emitting display according to a first embodiment of the present invention.

Referring to FIG. 1, the organic light emitting display according to the first embodiment of the present invention includes a display unit 130 including pixels 140 positioned at the crossing regions of scan lines S1 to Sn and data lines D1 to Dm, a scan driver 110 for driving the scan lines S1 to Sn, a data driver 120 for driving the data lines D1 to Dm, a first power source driver 160 for supplying a first power source ELVDD to the pixels 140, a second power source driver 170 for supplying a second power source ELVSS to the pixels 140, and a timing controller 150 for controlling the drivers 110, 120, 160, and 170.

Each of the pixels 140 is coupled to a data line (one of D1 to Dm), a scan line (one of S1 to Sn), the first power source ELVDD, and the second power source ELVSS. Each of the pixels 140 controls the amount of current that flows from the relatively high level first power source ELVDD to the relatively low level second power source ELVSS via an OLED (not shown in FIG. 1) to correspond to a data signal to generate light of a set or predetermined brightness.

The first power source driver 160 generates the first power source ELVDD and supplies the generated first power source ELVDD to the pixels 140. The first power source driver 160 supplies the first power source ELVDD at a low level or a high level (e.g., a relatively high or a relatively low voltage) in one frame period.

Figure 3:
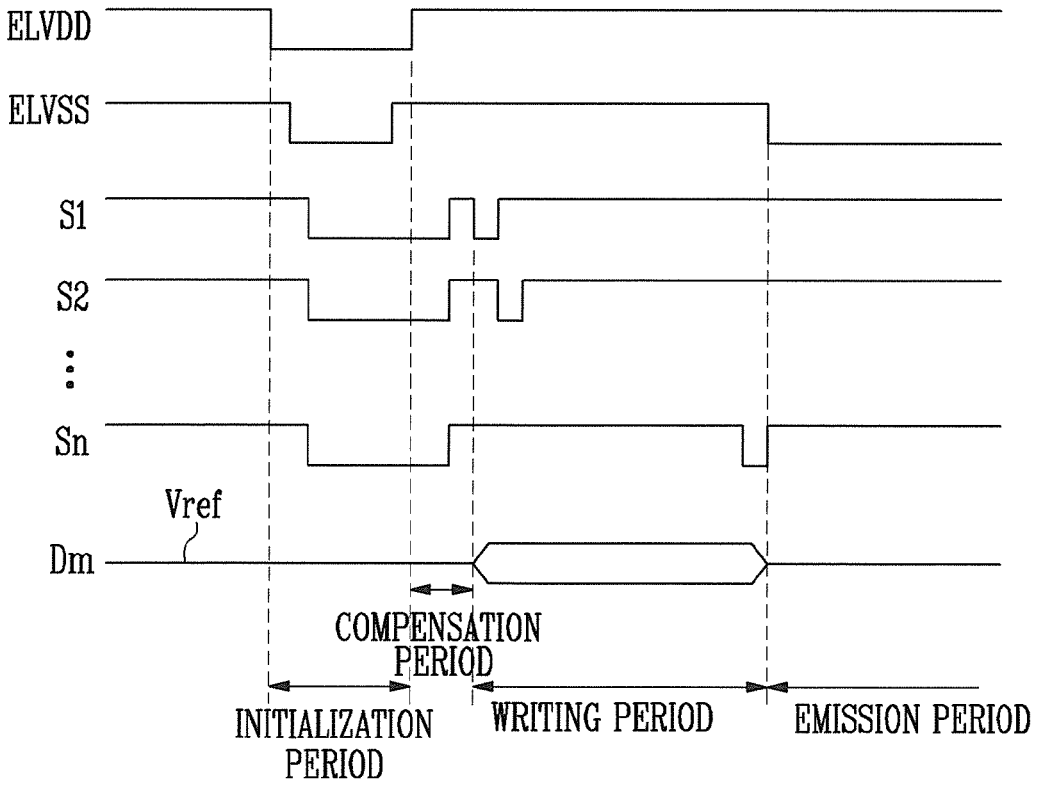
FIG. 3 is a waveform chart illustrating a method of driving the pixel of FIG. 2 according to an embodiment of the present invention.

Describing the above in more detail, the first power source driver 160 supplies the low level of the first power source ELVDD in an initialization period of one frame and supplies the high level of the first power source ELVDD in the other periods as illustrated in FIG. 3. The low level of the first power source ELVDD is a voltage by which the pixel 140 is set in a non-emission state. The high level of the first power source ELVDD is a voltage by which the pixel 140 is set in an emission state.

The second power source driver 170 generates the second power source ELVSS and supplies the generated second power source ELVSS to the pixels 140. The second power source driver 170 supplies the second power source ELVSS at a low level or high level (e.g., a relatively high or a relatively low voltage) in one frame period.

Describing the above in more detail, the second power source driver 170 supplies the low level of the second power source ELVSS in the initialization period and an emission period of one frame, and supplies the high level of the second power source ELVSS in the other periods as illustrated in FIG. 3. The low level of the second power source ELVSS is a voltage by which the pixel 140 is set in the emission state. The high level of the second power source ELVSS is a voltage by which the pixel 140 is set in the non-emission state. For example, the high level of the second power source ELVSS may be set as the same voltage as the high level of the first power source ELVDD, and the low level of the second power source ELVSS may be set as the same voltage as the low level of the first power source ELVDD.

The scan driver 110 concurrently (e.g., simultaneously) or sequentially supplies scan signals to the scan lines S1 to Sn. For example, the scan driver 110 concurrently (e.g., simultaneously) supplies the scan signals to the scan lines S1 to Sn in the initialization period and the compensation period, and sequentially supplies the scan signals to the scan lines S1 to Sn in a writing period (e.g., see FIG. 3). When the scan signals are sequentially supplied to the scan lines S1 to Sn, the pixels 140 are selected in units of horizontal lines (e.g., line-by-line).

The data driver 120 supplies data signals to the data lines D1 to Dm in synchronization with the scan signals in the writing period. The data driver 120 supplies a reference voltage Vref to the data lines D1 to Dm in the initialization period, a compensation period, and the emission period, excluding the writing period. The reference voltage Vref is set as a voltage equal to or higher than the data signal of a black gray level.

The timing controller 150 controls the scan driver 110, the data driver 120, the first power source driver 160, and the second power source driver 170 to correspond to synchronizing signals supplied from the outside of the organic light emitting display.

Figure 2:
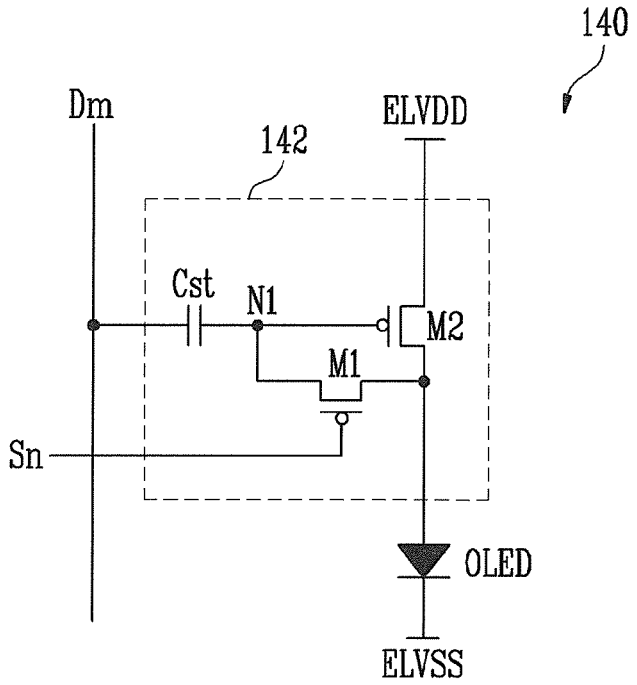
FIG. 2 is a view illustrating an embodiment of a pixel of FIG. 1 according to an embodiment of the present invention.

FIG. 2 is a view illustrating an embodiment of the pixel 140 of FIG. 1 according to the present invention. In FIG. 2, for convenience sake, the pixel 140 coupled to the n-th scan line Sn and the m-th data line Dm will be illustrated.

Referring to FIG. 2, the pixel 140 according to the embodiment of the present invention includes an OLED and a pixel circuit 142 coupled to the data line Dm and the scan line Sn to control the amount of current supplied to the OLED.

The anode electrode of the OLED is coupled to the pixel circuit 142, and the cathode electrode of the OLED is coupled to the second power source ELVSS. The OLED generates light of a set or predetermined brightness to correspond to the amount of current supplied from the pixel circuit 142 in the emission period.

The pixel circuit 142 is charged with a voltage corresponding to a data signal and controls the amount of current supplied to the OLED to correspond to the charged voltage. In FIG. 2, the pixel circuit 142 includes a first transistor M1, a second transistor M2, and a storage capacitor Cst.

The storage capacitor Cst is coupled between the data line Dm and a first node N1. The storage capacitor Cst is charged with a voltage corresponding to a data signal and the threshold voltage of the second transistor M2.

The first electrode of the second transistor M2 (e.g., the driving transistor) is coupled to the first power source ELVDD, and the second electrode of the second transistor M2 is coupled to the anode electrode of the OLED. The gate electrode of the second transistor M2 is coupled to the first node N1. The second transistor M2 controls the amount of current supplied to the OLED to correspond to the voltage applied to the first node N1.

The first electrode of the first transistor M1 is coupled to the second electrode of the second transistor M2, and the second electrode of the first transistor M1 is coupled to the first node N1. The gate electrode of the first transistor M1 is coupled to the scan line Sn. The first transistor M1 is turned on when a scan signal is supplied to the scan line Sn to couple the second transistor M2 in the form of a diode (e.g., diode-connected form).

FIG. 3 is a waveform chart illustrating a method of driving the pixel of FIG. 2 according to an embodiment of the present invention.

Referring to FIG. 3, one frame period is divided into the initialization period in which the voltage of the first node N1 is initialized, the compensation period in which the threshold voltage of the second transistor M2 is compensated for, the writing period in which the voltage corresponding to the data signal is charged in the pixel 140, and the emission period in which light is generated by the OLED.

First, in the initialization period, the low level of the first power source ELVDD and the low level of the second power source ELVSS are supplied. The low level of the second power source ELVSS is supplied to overlap the low level of the first power source ELVDD. When the low levels of the first and second power sources ELVDD and ELVSS are supplied, the pixels 140 are set in the non-emission state in the initialization period.

After the low level of the second power source ELVSS is supplied, the scan signals are concurrently (e.g., simultaneously) supplied to the scan lines S1 to Sn. When the scan signals are concurrently (e.g., simultaneously) supplied to the scan lines s1 to Sn, the first transistor M1 included in each of the pixels 140 is turned on. When the first transistor M1 is turned on, the voltage of the first node N1 is dropped to the voltage of the low level of the first power source ELVDD.

In the compensation period, the high levels of the first and second power sources ELVDD and ELVSS are supplied. In the compensation period, the scan signals supplied to the scan lines S1 to Sn are maintained. When the second power source ELVSS is set at the high level, the voltage of the first node N1 is increased by a set or predetermined voltage. The voltage of the first node N1 is increased by the voltage obtained by subtracting the threshold voltage of the OLED from the voltage of the high level of the second power source ELVSS.

When the first power source ELVDD is set at the high level, the voltage of the first node N1 is set as the voltage obtained by subtracting the threshold voltage of the second transistor M2 from the voltage of the first power source ELVDD. Therefore, according to the embodiment of FIG. 2, the threshold voltage of the OLED is set to be higher than the threshold voltage of the second transistor M2.

Operation processes will be described in detail by assuming that the high levels of the first and second power sources ELVDD and ELVSS are set as 4V, that the threshold voltage of the OLED is set as 2V, and that the threshold voltage of the second transistor M2 is set as 1V.

First, when the second power source ELVSS of 4V is supplied, the voltage of 2V is applied to the first node N1 by the threshold voltage 2V of the OLED. Then, when the first power source ELVDD of 4V is supplied, the first electrode of the second transistor M2 is set as 4V, and the first node N1 is set as 2V. In this case, the voltage applied to the first electrode of the second transistor M2 and the voltage applied to the first node N1 have a voltage difference that is no less than the threshold voltage of the second transistor M2 so that the second transistor M2 coupled in the form of diode is turned on. When the second transistor M2 is turned on, the voltage obtained by subtracting the threshold voltage of the second transistor M2 from the first power source ELVDD is applied to the first node N1.

On the other hand, in the compensation period, the reference voltage Vref is supplied to the data line Dm. Therefore, in the compensation period, a voltage difference between the reference voltage Vref and the first node N1, that is, a voltage corresponding to the threshold voltage of the second transistor M2, is charged in the storage capacitor Cst. On the other hand, the reference voltage Vref is set as a voltage equal to or higher than the voltage of the black data signal. In one embodiment, when the reference voltage Vref is set as the voltage equal to or higher than the voltage of the black data signal, gray levels may be stably realized.

In the writing period, the scan signals are sequentially supplied to the scan lines S1 to Sn, and the data signals are supplied to the data lines D1 to Dm. When the scan signal (e.g., a low level signal) is supplied to the scan line Sn, the first transistor M1 is turned on. When the first transistor M1 is turned on, the second transistor M2 is coupled in the form of a diode (e.g., diode-connected). In this case, the voltage of the first node N1 is maintained as the voltage obtained by subtracting the threshold voltage of the second transistor M2 from the voltage of the first power source ELVDD. At this time, a set or predetermined voltage is charged in the storage capacitor Cst to correspond to the data signal supplied to the data line Dm and the threshold voltage of the second transistor M2.

On the other hand, in the period where the scan signal is supplied to the n-th scan line Sn, the first node N1 of each of the pixels 140 coupled to the first scan line S1 to the (Sn−1)-th scan line Sn−1 is set in a floating state so that the voltage charged in the previous period is maintained.

In the emission period, the low level of the second power source ELVSS is supplied. When the low level of the second power source ELVSS is supplied, each of the pixels 140 supplies a current corresponding to the voltage charged therein from the first power source ELVDD at the high level to the second power source ELVSS at the low level via the OLED. Then, in the emission period, light of set or predetermined brightness is generated by each of the pixels 140.

As described above, according to the embodiment of FIGS. 1-3, the threshold voltage of the driving transistor M2 may be stably compensated for in the pixel 140 including the two transistors M1 and M2 and one capacitor Cst. On the other hand, according to various embodiments of the present invention, the structure of the pixel 140 may be changed into various types.

Figure 4:
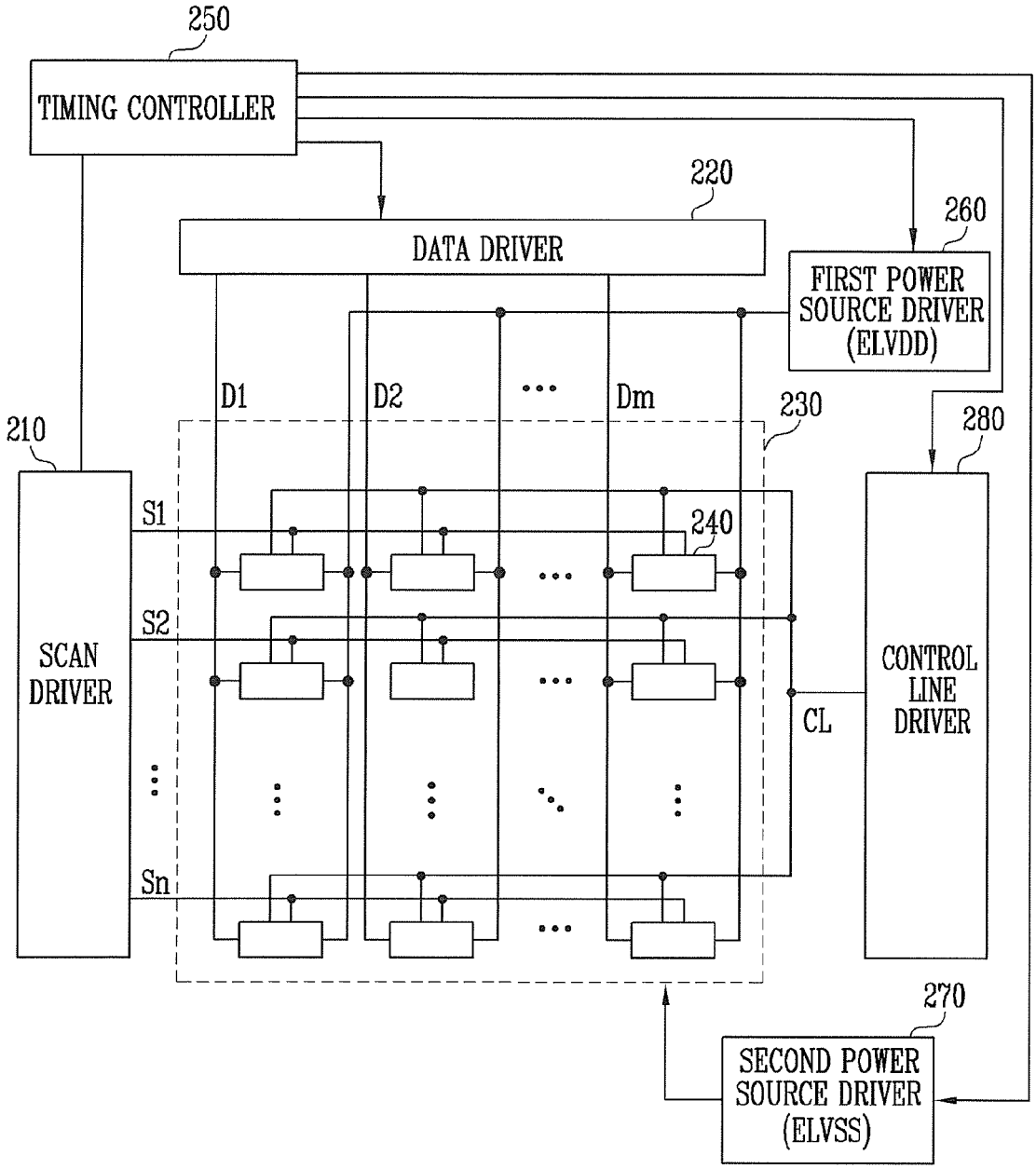
FIG. 4 is a view illustrating an organic light emitting display according to a second embodiment of the present invention.

FIG. 4 is a view illustrating an organic light emitting display according to a second embodiment of the present invention.

Referring to FIG. 4, the organic light emitting display according to the second embodiment of the present invention includes a display unit 230 including pixels 240 positioned at the crossing regions of scan lines S1 to Sn, data lines D1 to Dm, and a control line CL, a scan driver 210 for driving the scan lines S1 to Sn, a data driver 220 for driving the data lines D1 to Dm, a control line driver 280 for driving the control line CL, a first power source driver 260 for supplying a first power source ELVDD to the pixels 240, a second power source driver 270 for supplying a second power source ELVSS to the pixels 240, and a timing controller 250 for controlling the drivers 210, 220, 260, 270, and 280.

Each of the pixels 240 is coupled to the data line (one of D1 to Dm), the scan line (one of S1 to Sn), the control line CL, the first power source ELVDD, and the second power source ELVSS. Each of the pixels 240 generates light of a set or predetermined brightness while controlling the amount of current that flows from the first power source ELVDD at a relatively high level to the second power source ELVSS at a relatively low level via the OLED (not shown) to correspond to a data signal.

The first power source driver 260 generates the first power source ELVDD and supplies the generated first power source ELVDD to the pixels 240. The first power source driver 260 either supplies the high level of the first power source ELVDD in one frame period to correspond to the structure of the pixel 240, or supplies the first power source ELVDD that is repeatedly at a low level and a high level in one frame period. Detailed description of the above will be provided later with reference to the structure of the pixel 240.

The second power source driver 270 generates the second power source ELVSS and supplies the generated second power source ELVSS to the pixels 240. The second power source driver 270 supplies the low level of the second power source ELVSS in one frame period to correspond to the structure of the pixel 240 or supplies the second power source ELVSS that is repeatedly at a low level and a high level in one frame period. Detailed description of the above will be provided later with reference to the structure of the pixel 240.

The scan driver 210 concurrently (e.g., simultaneously) and/or sequentially supplies the scan signals to the scan lines S1 to Sn.

The data driver 220 supplies the data signals to the data lines D1 to Dm in synchronization with the sequentially supplied scan signals. The data driver 220 supplies the reference voltage Vref to the data lines D1 to Dm in the remaining periods, excluding the period in which the data signals are supplied.

The control line driver 280 supplies a control signal to the control line CL that is commonly coupled to the pixels 240.

The timing controller 250 controls the scan driver 210, the data driver 220, the first power source driver 260, the second power source driver 270, and the control line driver 280 to correspond to the synchronizing signals supplied from the outside of the organic light emitting display.

Figure 5:
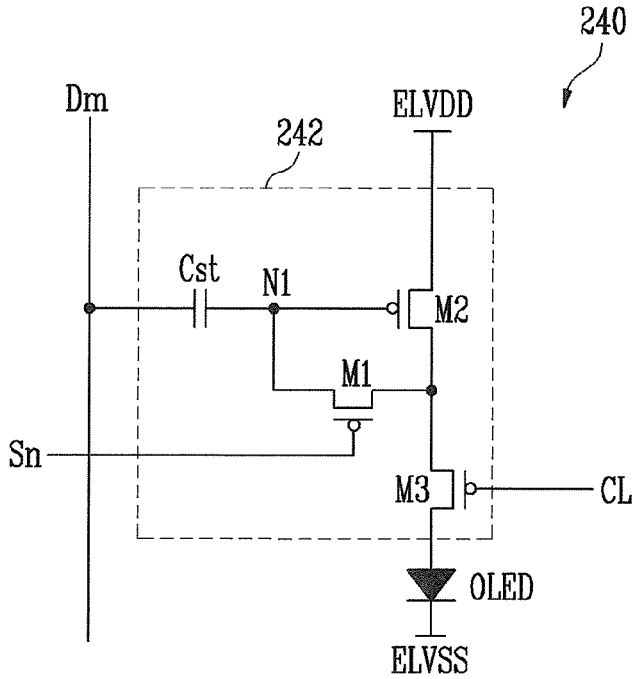
FIG. 5 is a view conceptually illustrating an embodiment of the pixel of FIG. 4.

FIG. 5 is a view illustrating an embodiment of the pixel 240 of FIG. 4. In FIG. 5, for convenience sake, the pixel 240 coupled to the n-th scan line Sn and the m-th data line Dm is illustrated.

Referring to FIG. 5, the pixel 240 includes an OLED and a pixel circuit 242 coupled to the data line Dm, the scan line Sn, and the control line CL to control the amount of current supplied to the OLED.

The anode electrode of the OLED is coupled to the pixel circuit 242, and the cathode electrode of the OLED is coupled to the second power source ELVSS. The OLED generates light of a set or predetermined brightness to correspond to the amount of current supplied from the pixel circuit 242 in the emission period.

The pixel circuit 242 is charged with a voltage corresponding to a data signal and controls the amount of current supplied to the OLED to correspond to the charged voltage. In FIG. 5, the pixel circuit 242 includes a first transistor M1, a second transistor M2, a third transistor M3, and a storage capacitor Cst.

The storage capacitor Cst is coupled between the data line Dm and a first node N1. The storage capacitor Cst is charged with a voltage corresponding to a data signal and the threshold voltage of the second transistor M2.

The first electrode of the second transistor M2 is coupled to the first power source ELVDD, and the second electrode of the second transistor M2 is coupled to the first electrode of the third transistor M3. The gate electrode of the second transistor M2 is coupled to the first node N1. The second transistor M2 controls the amount of current supplied to the OLED to correspond to the voltage applied to the first node N1.

The first electrode of the first transistor M1 is coupled to the second electrode of the second transistor M2, and the second electrode of the first transistor M1 is coupled to the first node N1. The gate electrode of the first transistor M1 is coupled to the scan line Sn. The first transistor M1 is turned on when a scan signal (e.g., a low level signal) is supplied to the scan line Sn to couple the second transistor M2 in the form of a diode (e.g., diode-connected).

The first electrode of the third transistor M3 is coupled to the second electrode of the second transistor M2, and the second electrode of the third transistor M3 is coupled to the anode electrode of the OLED. The gate electrode of the third transistor M3 is coupled to the control line CL. The third transistor M3 is turned on when the control signal (e.g., a low level signal) is supplied to the control line CL and is turned off when the control signal is not supplied.

Figure 6:
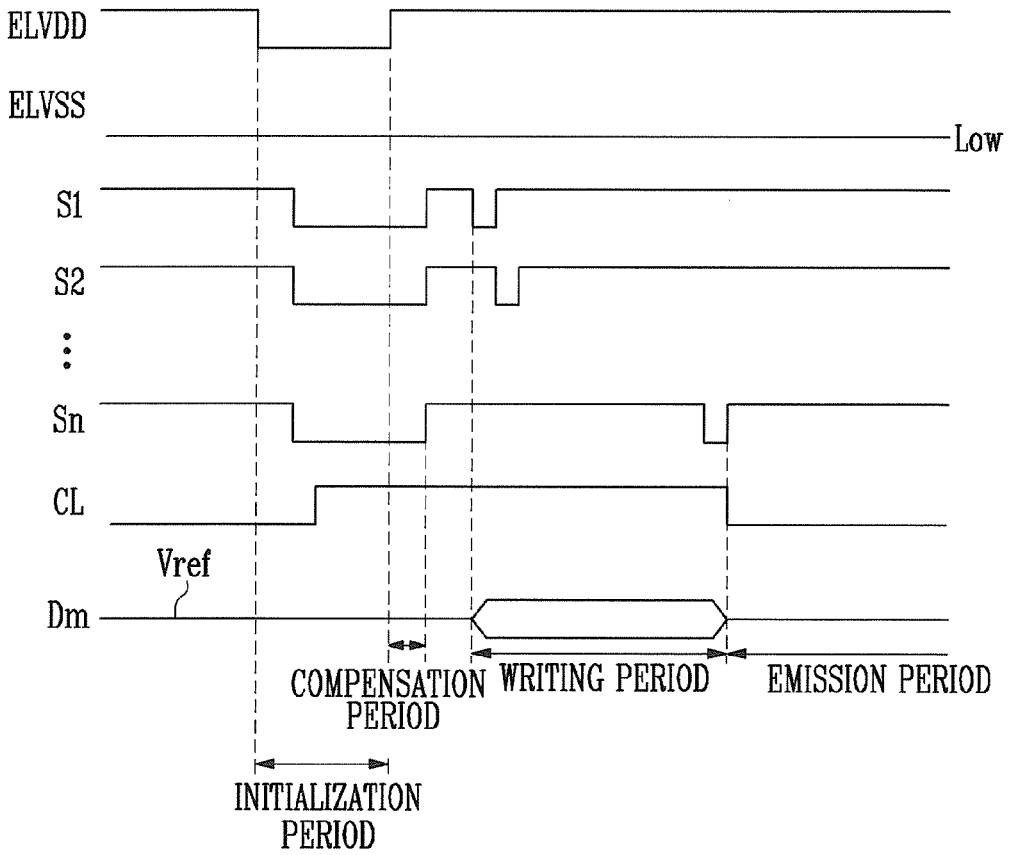
FIG. 6 is a waveform chart illustrating a method of driving the pixel of FIG. 5 according to an embodiment of the present invention.

FIG. 6 is a waveform chart illustrating a method of driving the pixel 240 of FIG. 5.

Referring to FIG. 6, one frame period is divided into the initialization period in which the voltage of the first node N1 is initialized, the compensation period in which the threshold voltage of the second transistor M2 is compensated for, the writing period in which the voltage corresponding to the data signal is charged at the pixel 240, and the emission period in which light is generated by the OLED.

In FIG. 6, the second power source ELVSS coupled to the pixel 240 of FIG. 5 maintains a low level voltage in one frame period without a change in voltage. That is, the pixel 240 of FIG. 5 adds the third transistor M3 in comparison with the pixel 140 of FIG. 2, and uniformly maintains the voltage of the second power source ELVSS.

Referring to FIG. 6, in the initialization period, the low level of the first power source ELVDD is supplied, and the scan signals are concurrently (e.g., simultaneously) supplied to the scan lines S1 to Sn. After the scan signals are concurrently (e.g., simultaneously) supplied to the scan lines S1 to Sn, the supply of the control signal to the control line CL is stopped. Actually, the control signal is supplied in the partial period of the initialization period and the emission period.

When the low level of the first power source ELVDD is supplied, the pixels 240 are set in the non-emission state. After the low level of the first power source ELVDD is supplied, the scan signals are concurrently (e.g., simultaneously) supplied to the scan lines S1 to Sn. When the scan signals are concurrently (e.g., simultaneously) supplied to the scan lines S1 to Sn, the first transistor M1 is turned on. When the first transistor M1 is turned on, the first node N1 is electrically coupled to the second power source ELVSS via the first transistor M1, the third transistor M3, and the OLED so that the voltage of the first node N1 is initialized to the voltage of the second power source ELVSS.

Then, the supply of the control signal to the control line CL is stopped (e.g., changed from a low level to a high level) so that the third transistor M3 is turned off. When the third transistor M3 is turned off, the second transistor M2 and the OLED are electrically isolated from each other.

In the compensation period, the voltage of the high level of the first power source ELVDD is supplied. In the compensation period, the scan signals supplied to the scan lines S1 to Sn are maintained. Since the first node N1 has been initialized, when the second power source ELVSS is set at the high level, the voltage of the first node N1 is set as the voltage obtained by subtracting the threshold voltage of the second transistor M2 from the voltage of the high level of the first power source ELVDD.

On the other hand, in the compensation period, the reference voltage Vref is supplied to the data line Dm. Therefore, in the compensation period, a voltage difference between the reference voltage Vref and that of the first node N1, that is, a voltage corresponding to the threshold voltage of the second transistor M2, is charged in the storage capacitor Cst.

In the writing period, the scan signals are sequentially supplied to the scan lines S1 to Sn, and the data signals are supplied to the data lines D1 to Dm. When the scan signal is supplied to the scan line Sn, the first transistor M1 is turned on. When the first transistor M1 is turned on, the second transistor M2 is coupled in the form of a diode (e.g., diode-connected). In this case, the voltage of the first node N1 is maintained as the voltage obtained by subtracting the threshold voltage of the second transistor M2 from the voltage of the first power source ELVDD. At this time, a set or predetermined voltage is charged in the storage capacitor Cst to correspond to the data signal supplied to the data line Dm and the threshold voltage of the second transistor M2.

In FIG. 6, in the period where the scan signal is supplied to the n-th scan line Sn, the first node N1 of each of the pixels 240 coupled to the first scan line S1 to the (Sn−1)-th scan line Sn−1, is set in a floating state so that the voltage charged in the previous period is maintained. In the writing period, since the control signal is not supplied to the control line CL, the pixels 240 maintain the non-emission state.

In the emission period, the control signal is supplied to the control line CL. When the control signal is supplied to the control line CL, the third transistor M3 is turned on so that the second transistor M2 and the OLED are electrically coupled to each other. At this time, the second transistor M2 supplies the current corresponding to the voltage charged in the storage capacitor Cst to the OLED so that each of the pixels 240 generates light of a set or predetermined brightness.

As described above, according to the embodiment of FIGS. 4-6, the threshold voltage of the driving transistor M2 may be stably compensated in the pixel 240 including the three transistors M1, M2, and M3, and one capacitor Cst. In addition, when the pixel 240 includes the three transistors, the second power source ELVSS may be maintained as a uniform constant voltage.

Figure 7:
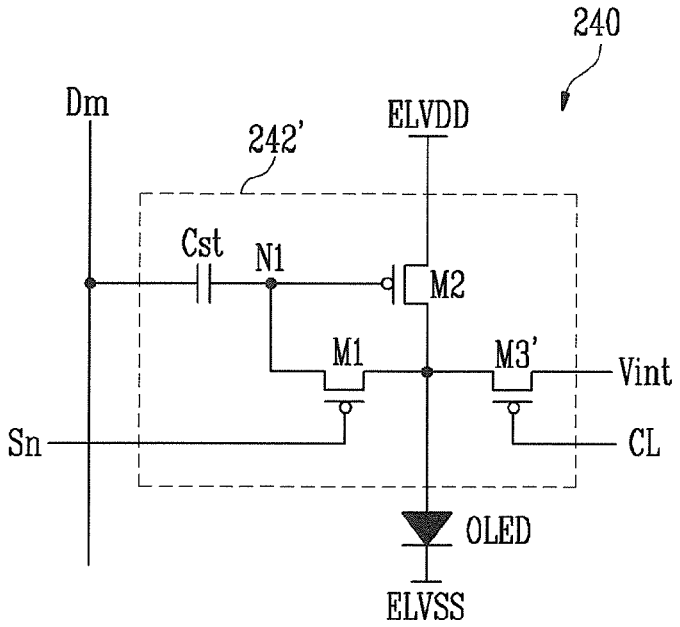
FIG. 7 is a view illustrating another embodiment of the pixel of FIG. 4.

FIG. 7 is a view illustrating another embodiment of the pixel 240 of FIG. 4.

Referring to FIG. 7, the pixel 240 includes an OLED and a pixel circuit 242' coupled to the data line Dm, the scan line Sn, and the control line CL to control the amount of current supplied to the OLED.

The anode electrode of the OLED is coupled to the pixel circuit 242', and the cathode electrode of the OLED is coupled to the second power source ELVSS. The OLED generates light of a set or predetermined brightness to correspond to the amount of current supplied from the pixel circuit 242' in the emission period.

The pixel circuit 242' is charged with a voltage corresponding to a data signal and controls the amount of current supplied to the OLED to correspond to the charged voltage. In FIG. 7, the pixel circuit 242' includes a first transistor M1, a second transistor M2, a third transistor M3', and a storage capacitor Cst.

The storage capacitor Cst is coupled between the data line Dm and a first node N1. The storage capacitor Cst is charged with a voltage corresponding to a data signal and the threshold voltage of the second transistor M2.

The first electrode of the second transistor M2 is coupled to the first power source ELVDD, and the second electrode of the second transistor M2 is coupled to the anode electrode of the OLED. The gate electrode of the second transistor M2 is coupled to the first node N1. The second transistor M2 controls the amount of current supplied to the OLED to correspond to the voltage applied to the first node N1.

The first electrode of the first transistor M1 is coupled to the second electrode of the second transistor M2, and the second electrode of the first transistor M1 is coupled to the first node N1. The gate electrode of the first transistor M1 is coupled to the scan line Sn. The first transistor M1 is turned on when a scan signal is supplied to the scan line Sn to couple the second transistor M2 in the form of a diode (e.g., diode-connected).

The first electrode of the third transistor M3' is coupled to the second electrode of the second transistor M2, and the second electrode of the third transistor M3' is coupled to an initialization power source Vint. The gate electrode of the third transistor M3' is coupled to the control line CL. The third transistor M3' is turned on when the control signal is supplied to the control line CL and is turned off when the control signal is not supplied.

In FIG. 7, the initialization power source Vint for initializing the voltage of the first node N1 is set as a voltage lower than that of the first power source ELVDD.

Figure 8:
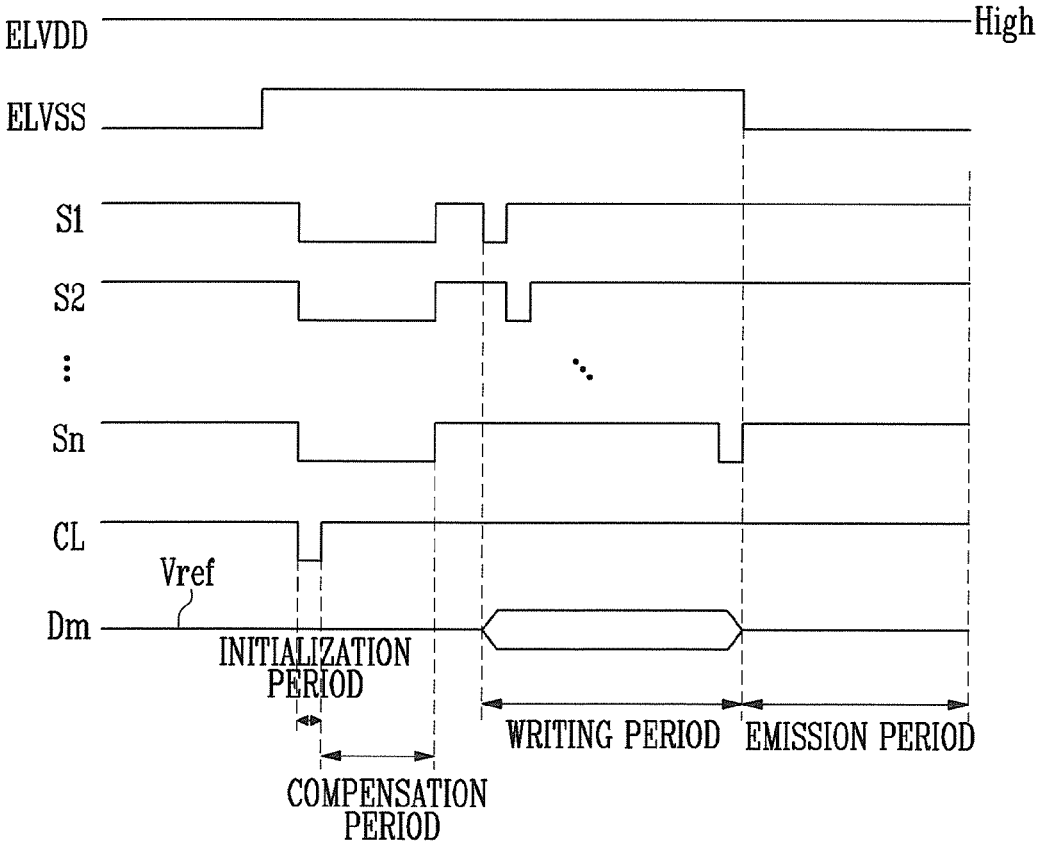
FIG. 8 is a waveform chart illustrating a method of driving the pixel of FIG. 7 according to an embodiment of the present invention.

FIG. 8 is a waveform chart illustrating a method of driving the pixel 240 of FIG. 7.

Referring to FIG. 8, one frame period is divided into an initialization period in which the voltage of the first node N1 is initialized, the compensation period in which the threshold voltage of the second transistor M2 is compensated for, the writing period in which the voltage corresponding to the data signal is charged in the pixel 240, and the emission period in which light is generated by the OLED.

In FIG. 8, the first power source ELVDD coupled to the pixel 240 of FIG. 7 maintains a high level voltage in one frame period without a change in a voltage. That is, the pixel 240 of FIG. 7 adds the third transistor M3' in comparison with the pixel 140 of FIG. 2 and uniformly maintains the voltage of the first power source ELVDD.

First, in the initialization period, the compensation period, and the writing period, the high level of the second power source ELVSS is supplied so that the pixels 240 are set in the non-emission state. In the initialization period and the compensation period, the scan signals are concurrently (e.g., simultaneously) supplied to the scan lines S1 to Sn. In addition, in the initialization period, the control signal is supplied to the control line CL.

When the scan signals are concurrently (e.g., simultaneously) supplied to the scan lines S1 to Sn, the first transistor M1 is turned on. When the control signal is supplied to the control line CL, the third transistor M3' is turned on. When the third transistor M3' is turned on, the voltage of the initialization power source Vint is supplied to the first node N1 via the third transistor M3' and the first transistor M1. That is, in the initialization period, the first node N1 is initialized to the voltage of the initialization power source Vint.

Then, the supply of the control signal to the control line CL is stopped in the compensation period. When the supply of the control signal to the control line CL is stopped, the third transistor M3' is turned off. When the third transistor M3' is turned off, the voltage obtained by subtracting the threshold voltage of the second transistor M2 from the voltage of the first power source ELVDD is supplied to the first node N1 by the second transistor M2 coupled in the form of a diode when the third transistor M3' is turned off.

On the other hand, in the compensation period, the reference voltage Vref is supplied to the data line Dm. Therefore, in the compensation period, a voltage difference between the reference voltage Vref and that of the first node N1, that is, a voltage corresponding to the threshold voltage of the second transistor M2, is charged in the storage capacitor Cst.

In the writing period, the scan signals are sequentially supplied to the scan lines S1 to Sn, and the data signals are supplied to the data lines D1 to Dm. When the scan signal is supplied to the scan line Sn, the first transistor M1 is turned on. When the first transistor M1 is turned on, the second transistor M2 is coupled in the form of a diode. In this case, the voltage of the first node N1 is maintained as the voltage obtained by subtracting the threshold voltage of the second transistor M2 from the voltage of the first power source ELVDD. At this time, a set or predetermined voltage is charged in the storage capacitor Cst to correspond to the data signal supplied to the data line Dm and the threshold voltage of the second transistor M2.

On the other hand, in the period where the scan signal is supplied to the n-th scan line Sn, the first node N1 of each of the pixels 240 coupled to the first scan line S1 to the (Sn−1)-th scan line Sn−1, is set in a floating state so that the voltage charged in the previous period is maintained.

In the emission period, the voltage of the low level of the second power source ELVSS is supplied. At this time, the second transistor M2 supplies the current corresponding to the voltage charged in the storage capacitor Cst to the OLED so that each of the pixels 240 generates light of a set or predetermined brightness.

As described above, according to the embodiment of FIGS. 7 and 8, the threshold voltage of the driving transistor M2 may be stably compensated for in the pixel 240 including the three transistors M1, M2, and M3', and one capacitor Cst. In addition, when the pixel 240 includes the three transistors, the first power source ELVDD may be maintained as a uniform constant voltage.

Figure 9:
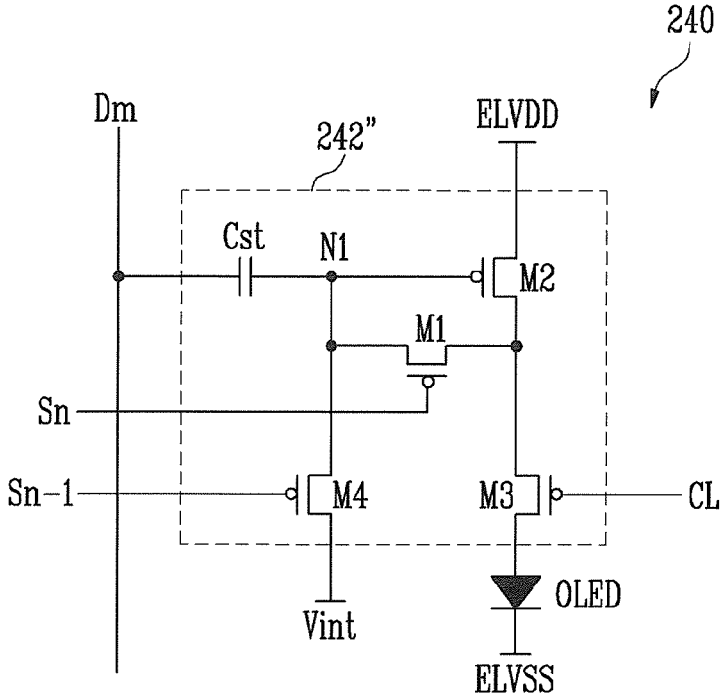
FIG. 9 is a view illustrating still another embodiment of the pixel of FIG. 4.

FIG. 9 is a view illustrating still another embodiment of the pixel 240 of FIG. 4.

Referring to FIG. 9, the pixel 240 according to the still another embodiment of the present invention includes an OLED and a pixel circuit 242" coupled to the data line Dm, the scan line Sn, and the control line CL to control the amount of current supplied to the OLED.

The anode electrode of the OLED is coupled to the pixel circuit 242", and the cathode electrode of the OLED is coupled to the second power source ELVSS. The OLED generates light of a set or predetermined brightness to correspond to the amount of current supplied from the pixel circuit 242" in the emission period.

The pixel circuit 242" is charged with a voltage corresponding to a data signal and controls the amount of current supplied to the OLED to correspond to the charged voltage. In FIG. 9, the pixel circuit 242" includes a first transistor M1, a second transistor M2, a third transistor M3, a fourth transistor M4, and a storage capacitor Cst.

The storage capacitor Cst is coupled between the data line Dm and a first node N1. The storage capacitor Cst is charged with a voltage corresponding to a data signal and the threshold voltage of the second transistor M2.

The first electrode of the second transistor M2 is coupled to the first power source ELVDD, and the second electrode of the second transistor M2 is coupled to the first electrode of the first transistor M1. The gate electrode of the second transistor M2 is coupled to the first node N1. The second transistor M2 controls the amount of current supplied to the OLED to correspond to the voltage applied to the first node N1.

The first electrode of the first transistor M1 is coupled to the second electrode of the second transistor M2, and the second electrode of the first transistor M1 is coupled to the first node N1. The gate electrode of the first transistor M1 is coupled to the n-th scan line Sn. The first transistor M1 is turned on when a scan signal is supplied to the n-th scan line Sn to couple the second transistor M2 in the form of a diode.

The first electrode of the third transistor M3 is coupled to the second electrode of the second transistor M2, and the second electrode of the third transistor M3 is coupled to the OLED. The gate electrode of the third transistor M3 is coupled to the control line CL. The third transistor M3 is turned on when the control signal is supplied to the control line CL and is turned off when the control signal is not supplied.

The first electrode of the fourth transistor M4 is coupled to the first node N1, and the second electrode of the fourth transistor M4 is coupled to the initialization power source Vint. The gate electrode of the fourth transistor M4 is coupled to the (n−1)-th scan line Sn−1. The fourth transistor M4 is turned on when a scan signal is supplied to the (n−1)-th scan line Sn−1 to initialize the first node N1 to the voltage of the initialization power source Vint.

Figure 10:
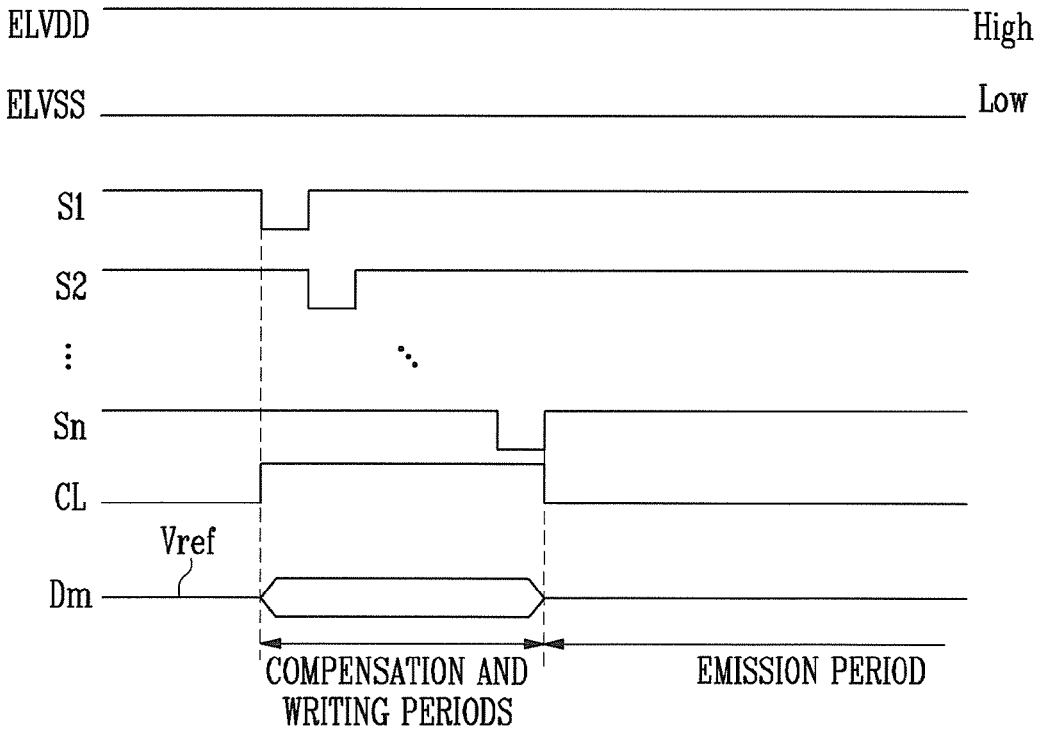
FIG. 10 is a waveform chart illustrating a method of driving the pixel of FIG. 9 according to an embodiment of the present invention.

FIG. 10 is a waveform chart illustrating a method of driving the pixel of FIG. 9 according to an embodiment of the present invention.

Referring to FIG. 10, one frame period is divided into the compensation and writing periods in which the voltage corresponding to the threshold voltage of the second transistor M2 and the data signal is charged in the pixel 240, and the emission period in which light is generated by the OLED.

In FIG. 10, the first power source ELVDD coupled to the pixel 240 of FIG. 9 maintains a high level voltage in one frame period without a change in voltage, and the second power source ELVSS maintains a low level voltage in one frame period. That is, the pixel 240 of FIG. 9 adds a third transistor M3 and a fourth transistor M4 in comparison with the pixel 140 of FIG. 2 so that the first power source ELVDD and the second power source ELVSS are maintained as uniform voltages.

Referring to FIG. 10, in the compensation and writing periods, the scan signals are sequentially supplied to the scan lines S1 to Sn. In the compensation and writing periods, the control signal is not supplied to the control line CL.

When the control signal is not supplied to the control line CL, the third transistor M3 is turned off so that the pixels 240 are set in the non-emission state.

When the scan signal is supplied to the (n−1)-th scan line Sn−1, the fourth transistor M4 is turned on. When the fourth transistor M4 is turned on, the voltage of the initialization power source Vint is supplied to the first node N1.

Then, when the scan signal is supplied to the n-th scan line Sn, the first transistor M1 is turned on. When the first transistor M1 is turned on, the second transistor M2 is coupled in the form of a diode. Therefore, the voltage obtained by subtracting the threshold voltage of the second transistor M2 from that of the first power source ELVDD is applied to the first node N1. At this time, the storage capacitor Cst is charged with a set or predetermined voltage corresponding to the data signal supplied to the data line Dm and the voltage applied to the first node N1.

On the other hand, in the period where the scan signal is supplied to the n-th scan line Sn, the first node N1 of each of the pixels 240 coupled to the first scan line S1 to the (Sn−1)-th scan line Sn−1 is set in a floating state so that the voltage charged in a previous period is maintained.

In the emission period, the control signal is supplied to the control line CL. When the control signal is supplied to the control line CL, the third transistor M3 is turned on. When the third transistor M3 is turned on, the second transistor M2 and the OLED are electrically coupled to each other. At this time, the second transistor M2 supplies a current corresponding to the voltage charged in the storage capacitor Cst to the OLED so that each of the pixels 240 generates light of a set or predetermined brightness.

As described above, according to the still another embodiment of the present invention, the threshold voltage of the driving transistor M2 may be stably compensated for using the pixel 240 of FIG. 9 including the four transistors M1, M2, M3, and M4, and one capacitor Cst. In addition, when the four transistors are included in the pixel 240, the first power source ELVDD and the second power source ELVSS may be maintained as constant voltages.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode (OLED) having a cathode electrode coupled to a second power source, and an anode electrode;

a storage capacitor coupled between a data line and a first node;

a second transistor having a first electrode coupled to a first power source, a second electrode coupled to the anode electrode of the OLED, and a gate electrode directly coupled to the first node;

a first transistor having a first electrode directly coupled to the first node, a second electrode directly coupled to the second electrode of the second transistor, and a gate electrode coupled to a current scan line; and a third transistor having a first electrode directly coupled to the second electrode of the second transistor, a second electrode directly coupled to the anode electrode of the OLED, and a gate electrode coupled to a control line, wherein the control line is commonly coupled to an adjacent pixel in a same column as the pixel and to another adjacent pixel in a same row as the pixel, such that the pixel, the adjacent pixel, and the another adjacent pixel receive a control signal through the control line at a same time, and wherein a threshold voltage of the OLED is set to be higher than a threshold voltage of the second transistor.

2. The pixel as claimed in claim 1, wherein the first power source is configured to be at a first voltage in a partial period of a frame period, and at a second voltage higher than the first voltage in other periods of the frame period.

3. The pixel as claimed in claim 2, wherein the third transistor is configured to be turned on in a portion of the partial period in which the first power source is at the first voltage.

4. The pixel as claimed in claim 2, wherein the first transistor is configured to be turned on in a period partially overlapped with a turn-on period of the third transistor.

5. The pixel as claimed in claim 1, wherein the first power source is configured to maintain a first voltage in a frame period, and wherein the second power source is configured to maintain a second voltage lower than the first voltage in the frame period.

6. The pixel as claimed in claim 5, further comprising a fourth transistor coupled between the first node and an initialization power source, a gate electrode of the fourth transistor being coupled to a previous scan line.

7. The pixel as claimed in claim 6, wherein the initialization power source is configured to be at a voltage lower than that of the first power source.

8. The pixel as claimed in claim 6, wherein a turn-on period of the third transistor is not overlapped with a turn-on period of the first transistor.

9. A pixel comprising:

an organic light emitting diode (OLED) having a cathode electrode coupled to a second power source, and an anode electrode;

a storage capacitor coupled between a data line and a first node;

a second transistor having a first electrode coupled to a first power source, a second electrode directly coupled to the anode electrode of the OLED, and a gate electrode directly coupled to the first node;

a first transistor having a first electrode directly coupled to the first node, a second electrode directly coupled to the second electrode of the second transistor, and a gate electrode coupled to a current scan line; and a third transistor coupled between the second electrode of the second transistor and an initialization power source, a gate electrode of the third transistor being coupled to a control line, wherein the control line is commonly coupled to an adjacent pixel in a same column as the pixel and to another adjacent pixel in a same row as the pixel, such that the pixel, the adjacent pixel, and the another adjacent pixel receive a control signal through the control line at a same time; and wherein a threshold voltage of the OLED is set to be higher than a threshold voltage of the second transistor.

10. The pixel as claimed in claim 9, wherein the second power source is configured to be at a first voltage in a partial period of a frame period, and at a second voltage lower than the first voltage in other periods of the frame period.

11. The pixel as claimed in claim 10, wherein the third transistor is configured to be turned on in the partial period in which the second power source is at the first voltage.

12. The pixel as claimed in claim 9, wherein the first transistor is configured to be turned on when the third transistor is turned on.

13. An organic light emitting display comprising:

pixels positioned at crossing regions of scan lines, data lines, and control lines wherein the pixels are arranged in three or more rows and three or more columns;

a scan driver for concurrently supplying scan signals to the scan lines in a first period of a frame period and for sequentially supplying the scan signals to the scan lines in a second period of the frame period;

a data driver for driving the data lines;

a control line driver for supplying a control signal to a control line commonly coupled to the pixels in a partial period of the first period, such that adjacent pixels of the pixels in a same column and other adjacent pixels of the pixels in a same row receive the control signal through the control line at a same time in the partial period;

a first power source driver for supplying a first power source to the pixels; and a second power source driver for supplying a second power source to the pixels, wherein at least one of the first power source or the second power source is at a voltage that changes repeatedly between a first voltage and a second voltage lower than the first voltage in the frame period.

14. The organic light emitting display as claimed in claim 13, wherein the second power source is maintained at the second voltage in the frame period, and wherein the first power source is at the second voltage in the first period to overlap the control signal and the scan signals in a partial period of the first period, and is at the first voltage in other periods of the frame period.

15. The organic light emitting display as claimed in claim 14, wherein the control line driver is configured to supply the control signal to the control line in a third period of the frame period.

16. The organic light emitting display as claimed in claim 15, wherein each of the pixels comprises:

an organic light emitting diode (OLED) having a cathode electrode coupled to the second power source, and an anode electrode;

a storage capacitor coupled between a data line of the data lines and a first node;

a second transistor having a first electrode coupled to the first power source, a second electrode coupled to the anode electrode of the OLED, and a gate electrode coupled to the first node;

a first transistor coupled between the first node and the second electrode of the second transistor and configured to be turned on when a scan signal of the scan signals is supplied to a scan line of the scan lines; and a third transistor coupled between the second electrode of the second transistor and the anode electrode of the OLED, and configured to be turned on when the control signal is supplied to the control line.

17. The organic light emitting display as claimed in claim 13, wherein the first power source remains at the first voltage in the frame period, and wherein the second power source is at the first voltage in the first period and the second period, and is configured to be at the second voltage in a third period of the frame period.

18. The organic light emitting display as claimed in claim 17, wherein each of the pixels comprises:

an organic light emitting diode (OLED) having a cathode electrode coupled to a second power source, and an anode electrode;

a storage capacitor coupled between a data line of the data lines and a first node;

a second transistor having a first electrode coupled to the first power source, a second electrode coupled to the anode electrode of the OLED, and a gate electrode coupled to the first node;

a first transistor coupled between the first node and the second electrode of the second transistor, and configured to be turned on when the scan signals are supplied to the scan lines; and a third transistor coupled between the second electrode of the second transistor and an initialization power source, and configured to be turned on when the control signal is supplied to the control line.

19. The organic light emitting display as claimed in claim 18, wherein the initialization power source is configured to be at a voltage lower than the first voltage.

20. The organic light emitting display as claimed in claim 13, wherein the data driver is configured to supply data signals to the data lines in synchronization with the scan signals in the second period.

21. The organic light emitting display as claimed in claim 13, wherein the data driver is configured to supply a voltage equal to or no less than a data signal of a black gray level, to the data lines in the first period and a third period of the frame period.

22. An organic light emitting display comprising:

pixels positioned at crossing regions of scan lines, data lines, and a control line commonly coupled to the pixels;

a scan driver for sequentially supplying scan signals to the scan lines in a first period of a frame period;

a data driver for supplying data signals to the data lines in synchronization with the scan signals; and a control driver for supplying a control signal to the control line in a second period of the frame period excluding the first period such that adjacent pixels of the pixels in a same column and other adjacent pixels of the pixels in a same row receive the control signal through the control line at the same time in the second period, wherein each of the pixels comprises:

an organic light emitting diode (OLED) having a cathode electrode coupled to a second power source, and an anode electrode;

a storage capacitor coupled between a data line of the data lines and a first node;

a second transistor having a first electrode coupled to a first power source, a second electrode coupled to the anode electrode of the OLED, and a gate electrode directly coupled to the first node;

a first transistor having a first electrode directly coupled to the first node and a second electrode directly coupled to the second electrode of the second transistor, and configured to be turned on when the scan signals are supplied to the scan lines;

a third transistor having a first electrode directly coupled to the second electrode of the second transistor and a second electrode directly coupled to the anode electrode of the OLED, and configured to be turned on when the control signal is supplied to the control line; and a fourth transistor coupled between the first node and an initialization power source, and configured to be turned on when a scan signal of the scan signals is supplied to a previous scan line of the scan lines, and wherein a threshold voltage of the OLED is set to be higher than a threshold voltage of the second transistor.

23. The organic light emitting display as claimed in claim 22, wherein the initialization power source is configured to be at a voltage lower than that of the first power source.

* * * * *